US009692184B2

(12) United States Patent
Kamikura et al.

(10) Patent No.: US 9,692,184 B2
(45) Date of Patent: Jun. 27, 2017

(54) ELECTRONIC DEVICE

(71) Applicant: Mitsubishi Electric Corporation, Chiyoda-ku (JP)

(72) Inventors: Mamoru Kamikura, Chiyoda-ku (JP); Hiroyuki Kimata, Chiyoda-ku (JP); Takahiro Oishi, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 14/783,917

(22) PCT Filed: Apr. 28, 2014

(86) PCT No.: PCT/JP2014/061820

§ 371 (c)(1),
(2) Date: Oct. 12, 2015

(87) PCT Pub. No.: WO2014/199738

PCT Pub. Date: Dec. 18, 2014

(65) Prior Publication Data

US 2016/0056581 A1 Feb. 25, 2016

(30) Foreign Application Priority Data

Jun. 14, 2013 (JP) ..... 2013-125251

(51) Int. Cl.
*H01R 12/00* (2006.01)
*H01R 13/648* (2006.01)
(Continued)

(52) U.S. Cl.
CPC ..... *H01R 13/6485* (2013.01); *H01R 12/7076* (2013.01); *H01R 12/71* (2013.01)

(58) Field of Classification Search
CPC ..... H01R 13/6485; H01R 13/648; H01R 12/7076; H01R 12/71
(Continued)

(56) References Cited

U.S. PATENT DOCUMENTS

2011/0317378 A1 12/2011 Wang et al.

FOREIGN PATENT DOCUMENTS

JP 2001 308586 11/2001
JP 2003 229213 8/2003
(Continued)

OTHER PUBLICATIONS

International Search Report Issued Jul. 29, 2014 in PCT/JP14/061820 Filed Apr. 28, 2014.
(Continued)

*Primary Examiner* — Khiem Nguyen
(74) *Attorney, Agent, or Firm* — Oblon, McClelland, Maier & Neustadt, L.L.P.

(57) ABSTRACT

An electronic device includes the memory card connector including a loading opening for the memory card in the side face thereof and has a first sidewall and a second sidewall facing each other, the printed wire board on which a ground is formed, and a resin case having an opening portion, through which the memory card is inserted and formed in the sidewall of the loading opening. On the second main face of the printed wire board, there are formed a first electrode and a second electrode that are connected with the ground, that are disposed on the respective ends thereof at the loading opening side, and that are independent from each other, and the first electrode is disposed below the first sidewall of the memory card connector and the second electrode is disposed below the second sidewall of the memory card connector.

12 Claims, 10 Drawing Sheets

(51) Int. Cl.
*H01R 12/71* (2011.01)
*H01R 12/70* (2011.01)

(58) Field of Classification Search
USPC ..... 439/76.1, 79, 92, 181
See application file for complete search history.

(56) References Cited

FOREIGN PATENT DOCUMENTS

| | | |
|---|---|---|
| JP | 2004 134453 | 4/2004 |
| JP | 2008 153179 | 7/2008 |
| JP | 2008 181689 | 8/2008 |
| JP | 2008 226786 | 9/2008 |
| TW | 201201635 A1 | 1/2012 |

OTHER PUBLICATIONS

Japanese Office Action Issued Aug. 18, 2015 in a corresponding JP Application No. JP2015 522638 with English translation.
Combined Taiwanese Office Action and Search Report issued Feb. 19, 2016 in Patent Application No. 103118546 (with English language translation).

ELECTRONIC DEVICE

TECHNICAL FIELD

The present invention relates to an electronic device and particularly to an electronic device provided with an opening portion through which a memory card is inserted thereinto.

BACKGROUND ART

Electronic devices for memory cards are widely utilized. A memory card is inserted into or extracted from the electronic device through an opening portion. A printed wire board on which electronic components are mounted is fixed inside a case of the electronic device. The opening portion is provided at an arbitrary face of the electronic device. When in the case where a human body is electrically charged, the memory card is inserted into the electronic device, static electricity may be discharged toward the printed wire board thereof. An invention is known in which in order to protect the printed wire board of the electronic device from static electricity, a discharging conductive unit against static electricity is provided in the case (refer to Patent Documents 1 through 5). The discharging conductive unit is provided, for example, on a plane the same as that of the printed wire board. The discharging conductive unit is also referred to as an electrostatic induction plate.

In such an electronic device as described above, the discharging conductive unit (or the electrostatic induction plate) is disposed at a position nearest from the electronic device situated at the opening portion of the case. A memory card connector is mounted in the printed wire board in such a way that the respective centers of the opening portion of the memory card connector and the case coincide with each other. The memory card connector acts, as a discharging conductive unit, on the memory card connector side of the printed wire board. However, because no discharging conductive unit exists at the side, of the printed wire board, that is opposite to the memory card connector side thereof, static electricity may reach the memory card.

PRIOR ART REFERENCE

Patent Document

[Patent Document 1] Japanese Patent Application Laid-Open No. 2010-135230 (from 37th line of Page 5 to 8th line of Page 9, and FIG. 5)

[Patent Document 2] Japanese Patent Application Laid-Open No. 2003-229213

[Patent Document 3] Japanese Patent Application Laid-Open No. 2013-126132

[Patent Document 4] Japanese Patent Application Laid-Open No. 2006-195643

[Patent Document 5] Japanese Patent Application Laid-Open No. 2011-18746

DISCLOSURE OF THE INVENTION

Problem(s) to be Solved by the Invention

The present invention has been implemented in order to solve the foregoing problem. With regard to a component such as a memory card connector, which is mounted in parallel with a printed wire board, the objective thereof is to obtain a structure that can raise at low cost the withstanding amount against static electricity from not only the memory card connector side of the printed wire board but also the side thereof opposite to the memory card connector side.

Means for Solving the Problems

An electronic device according to the present invention includes a memory card connector that is provided with a loading opening for a memory card in the side face thereof and has a first sidewall and a second sidewall facing each other, a printed wire board that has a first main face and a second main face facing each other, on which a ground is formed, and on the first main face of which the memory card connector is placed leaving a margin at the loading opening side, and a resin case that contains the printed wire board and the memory card connector and in the sidewall of which at the loading opening side, an opening portion through which the memory card is inserted is formed. The electronic device according to the present invention is characterized in that on the second main face of the printed wire board, there are formed a first electrode and a second electrode that are connected with the ground, that are disposed on the respective ends thereof at the loading opening side, and that are independent from each other, and in that the first electrode is disposed below the first sidewall of the memory card connector and the second electrode is disposed below the second sidewall of the memory card connector.

Advantage of the Invention

In the present invention, an electrostatic-protection electrode is provided; therefore, with regard to a component such as a memory card connector, which is mounted in parallel with a printed wire board, it is possible to raise the withstanding amount against static electricity from not only the memory card connector side of the printed wire board but also the side thereof opposite to the memory card connector side.

BEST MODE FOR CARRYING OUT THE INVENTION

Hereinafter, Embodiments of an electronic device according to the present invention will be explained in detail with reference to the drawings. The present invention is not limited to the following descriptions but can appropriately be modified within a scope that does not deviate from its spirits.

Embodiment 1

Figure 1:
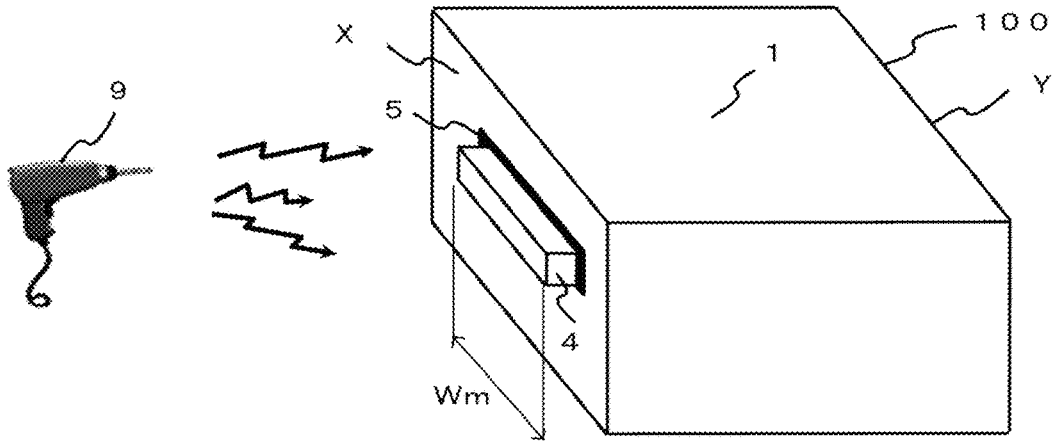
FIG. 1 is an external perspective view illustrating an electronic device according to Embodiment 1 of the present invention.

FIG. 1 is an external perspective view illustrating an electronic device 100 according to Embodiment 1 of the present invention. A memory card 4 having a transverse width of Wm is inserted into the electronic device 100. In general, the electronic device 100 such as a memory card reader is utilized being laid sideways in such a way that the opening portion 5 thereof faces the front. The electronic device 100 has a loading opening side (front side) X and a rear side Y. The opening portion 5 of a resin case 1 is provided at the loading opening side (front side) X. The memory card 4 is inserted into or extracted from the electronic device 100 through the opening portion 5. A discharging electric machine 9 (or a discharging unit 9) generates static electricity.

Figure 2:
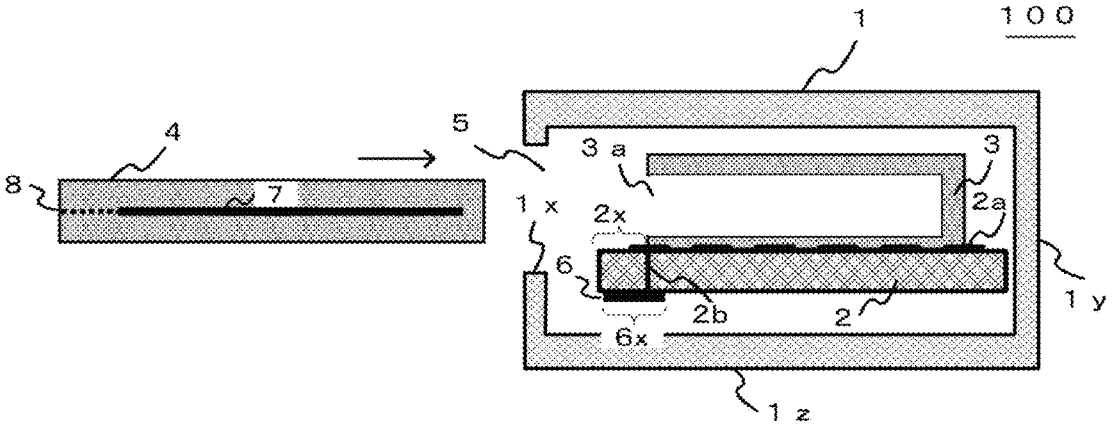
FIG. 2 is a side cross-sectional view illustrating the electronic device according to Embodiment 1 of the present invention.

FIG. 2 is a side cross-sectional view illustrating the electronic device 100 according to Embodiment 1 of the present invention. The electronic device 100 is configured with the resin case 1, a printed wire board 2, a memory card connector 3, and the like. A side wall 1*x* at the loading opening side of the resin case 1 and a side wall 1*y* at the rear side thereof are provided perpendicularly to a bottom side 1*z* thereof. The memory card connector 3 is placed on the surface (a first main face) of the printed wire board 2 contained in the resin case 1. A loading opening 3*a* for a memory card is provided at one end face of the memory card connector 3. The other end face of the memory card connector 3 is closed. The memory card 4 inserted through the opening portion 5 of the resin case 1 is loaded on the memory card connector 3 through the loading opening 3*a*. The memory card 4 is divided into an upper portion and a lower portion and is provide with an IC (integrated circuit) 7 on the division plane. A gap 8 slightly exists on the division plane. An electrode 6 connected with a ground layer 2*a* (or a ground strip conductor) is formed on the rear side (a second main face) of the printed wire board 2. The word "grand" may also be expressed as "ground"; therefore, hereinafter, the word "ground" is utilized as the standardized word. In addition, the electrode 6 may also be expressed as an electrostatic induction plate 6.

The electrode 6 (or the electrostatic induction plate 6) is disposed at one end, of the printed wire board 2, that is in the vicinity of the loading opening. The memory card connector 3 and the electrode 6 are connected with the ground layer (or the ground strip conductor) 2*a* by means of a via hole (or a wiring strip conductor) 2*b*. The electrode 6 can be formed in the same manner as the land on which components are mounted. For example, the electrode 6 can be formed in such a way that in a reflow process, a metal mask is utilized and a soldering paste is disposed. Because the memory card connector 3 is placed at a position, on the printed wire board 2, that is distal to the end face thereof in the vicinity of the loading opening, a margin 2*x* remains at a portion, of the printed wire board 2, that is in the vicinity of the loading opening. The electrode 6 is provided at a position, on the printed wire board 2, that is opposite to the memory card connector 3 side and is closer to the opening portion 5 than the memory card connector 3. It is desirable that the longitudinal width 6*x* of the electrode 6 is larger than the depth of a margin 2*x*.

Figure 3:
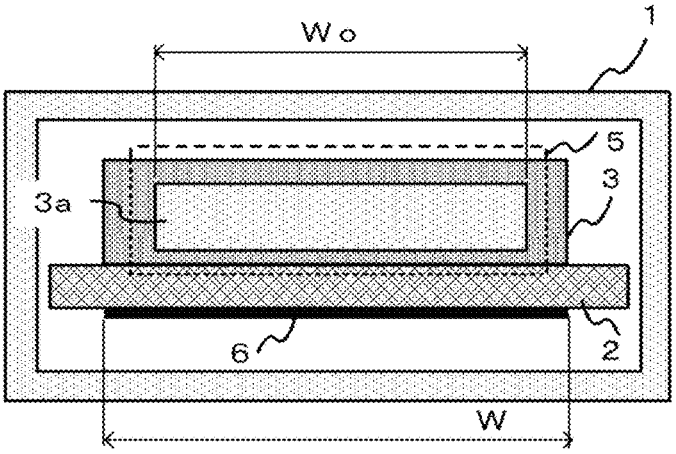
FIG. 3 is a front cross-sectional view illustrating the electronic device according to Embodiment 1 of the present invention.

FIG. 3 is a front cross-sectional view illustrating the electronic device 100 according to Embodiment 1 of the present invention. The electrode 6 formed on the rear side of the printed wire board 2 is disposed in such a way as to expand across the respective extended lines of the left and right sides of the inserted memory card 4. In other words, it is desirable that the transverse width (W) of the electrode 6 is larger than the transverse width (Wo) of the loading opening 3*a* of the memory card connector 3 or the transverse width (Wm) of the memory card 4. Hereinafter, there will be described the behavior of static electricity from a human body or static electricity generated by the discharging unit 9, which are applied to the opening portion 5.

When static electricity is applied from the upper portion of the memory card 4 to the printed wire board 2, the static electricity is led to the memory card connector 3. The memory card connector 3 prevents the static electricity from being applied to IC 7 by way of the gap 8 of the memory card 4. Because the memory card connector 3 is disposed in the electronic device 100, static electricity is hardly led from the upper portion of the memory card 4 to IC 7. As a result, the malfunction, caused by static electricity, in the circuit electrically connected with IC 7 can be suppressed.

When static electricity is applied from the lower portion of the memory card 4 to the printed wire board 2, the static electricity is hardly led to the memory card connector 3 because there exists almost no gap between the memory card 4 and the memory card connector 3. When there exists no electrode 6, static electricity may applied to IC 7 through the gap 8 of the memory card 4; however, even when applied to the opening portion 5, static electricity from a human body or static electricity generated by the discharging unit 9 can be led to the electrode 6 because the electrode 6 is provided.

In comparison with the case where there exists no electrode 6, the withstanding amount against static electricity increases.

As described above, when the electrode 6 is provided in such a way as to be at the side, of the printed wire board 2, that is opposite to the memory card connector 3 side, to be larger than the transverse width of the memory card 4, and to be closer to the opening portion 5 than the memory card connector 3, static electricity can be led to the electrode 6 not only when the static electricity is applied from the opening portion 5 above the memory card 4 but also when the static electricity is applied from the lower portion of the memory card 4. Accordingly, static electricity can be suppressed from reaching IC 7 of the memory card 4; thus, in comparison with the case where there exists no electrode 6, the withstanding amount against static electricity can be raised at low cost.

Embodiment 2

Figure 4:
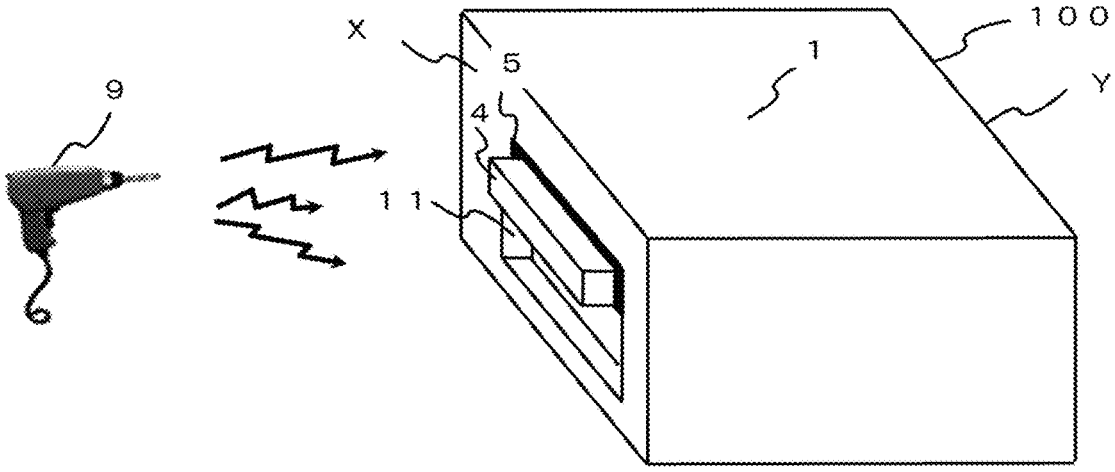
FIG. 4 is an external perspective view illustrating an electronic device according to Embodiment 2 of the present invention.

FIG. 4 is an external perspective view illustrating an electronic device 100 according to Embodiment 2 of the present invention. The memory card 4 is inserted into the electronic device 100. In general, the electronic device 100 such as a memory card reader is utilized being laid sideways in such a way that the opening portion 5 thereof faces the front. The electronic device 100 has the loading opening side (front side) X and the rear side Y. The opening portion 5 of the resin case 1 is provided at the loading opening side (front side) X. The memory card 4 is inserted into or extracted from the electronic device 100 through the opening portion 5. For the purpose of making it possible that the memory card 4 is inserted or extracted more easily, a recess 11 is formed in the opening portion 5 of the resin case 1. In other words, a recess is made inward in the lower section of the opening portion 5. The discharging unit 9 generates static electricity.

Figure 5:
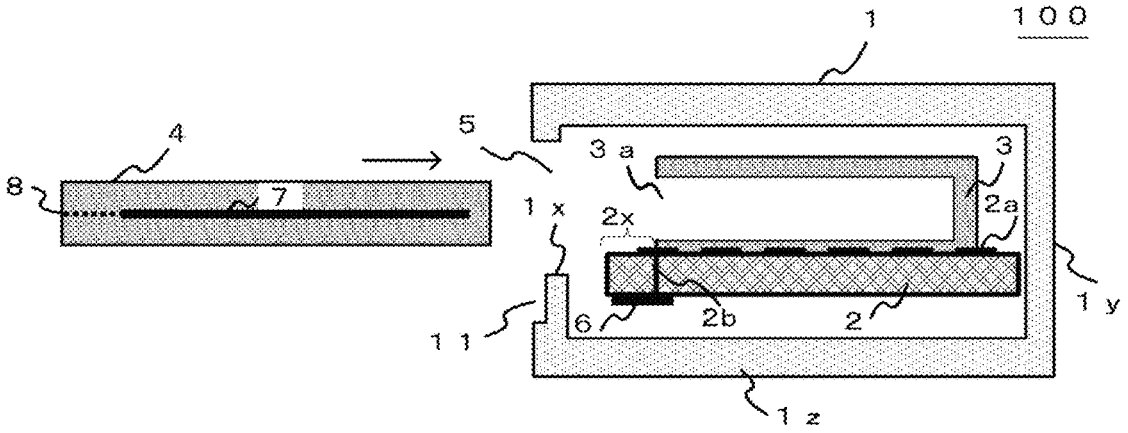
FIG. 5 is a side cross-sectional view illustrating the electronic device according to Embodiment 2 of the present invention.

FIG. 5 is a side cross-sectional view illustrating the electronic device 100 according to the present invention. The electronic device 100 is configured with the resin case 1, the printed wire board 2, the memory card connector 3, and the like. The side wall 1*x* at the loading opening side of the resin case 1 and the side wall 1*y* at the rear side thereof are provided perpendicularly to the bottom side 1*z* thereof. The recess 11 of the opening portion 5 is provided at a portion, of the side wall 1*x*, that is in the vicinity of the bottom side 1*z*. The memory card connector 3 is placed on the surface of the printed wire board 2 contained in the resin case 1. The loading opening 3*a* for a memory card is provided at one end face of the memory card connector 3. The memory card 4 inserted through the opening portion 5 of the resin case 1 is loaded on the memory card connector 3 through the loading opening 3*a*. The memory card 4 is divided into the upper portion and the lower portion and is provide with IC (integrated circuit) 7 on the division plane. The small gap 8 exists on the division plane. The electrode (or the electrostatic induction plate) 6 connected with the ground layer (or the ground strip conductor) 2*a* is formed on the rear side of the printed wire board 2.

The electrode 6 is disposed at one end, of the printed wire board 2, that is in the vicinity of the loading opening. The memory card connector 3 and the electrode 6 are connected with the ground layer (or the ground strip conductor) 2*a* by means of the via hole (or the wiring strip conductor) 2*b*. The electrode can be formed in the same manner as the land on which components are mounted. For example, the electrode 6 can be formed in such a way that in a reflow process, a metal mask is utilized and a soldering paste is disposed. Because the memory card connector 3 is placed at a position, on the printed wire board 2, that is distal to the end face thereof in the vicinity of the loading opening, the margin 2*x* remains at a portion, of the printed wire board 2, that is in the vicinity of the loading opening. The electrode 6 is provided at a position, on the printed wire board 2, that is opposite to the memory card connector 3 side and is closer to the opening portion 5 than the memory card connector 3. The longitudinal width of the electrode 6 is larger than the depth of the margin 2*x*.

For the purpose of making it possible that the memory card is inserted or extracted more easily, the electronic device 100 according to Embodiment 2 has the recess 11 in the opening portion 5 of the resin case 1. The distance between a human body or the discharging unit 9 and the electrode 6 is made shorter by the recess 11; therefore, static electricity from the human body or static electricity generated by the discharging unit 9 can further readily be led to the electrode 6 and hence the withstanding amount against static electricity can further be raised.

Embodiment 3

Figure 6:
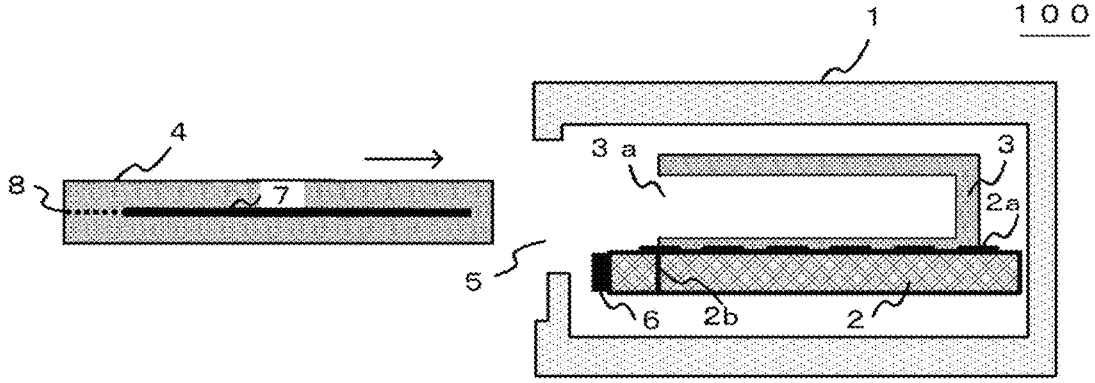
FIG. 6 is a side cross-sectional view illustrating an electronic device according to Embodiment 3 of the present invention.

In each of Embodiments 1 and 2, the electrode (or the electrostatic induction plate) 6 provided on the printed wire board 2 is disposed on the side, of the printed wire board 2, that is opposed to the memory card connector 3 side. In Embodiment 3, as illustrated in FIG. 6, an electrode 6 provided on the printed wire board 2 is disposed on one end face, of the printed wire board 2, that is in the vicinity of a loading opening thereof. The end face of the printed wire board 2 denotes the face that is perpendicular to the side of the printed wire board 2, on which components such as the memory card connector 3 and the like are mounted, and that faces the opening portion 5. In this case, the electrode 6 is connected with the ground strip conductor on a layer the same as that of the memory card connector 3 or connected with the ground strip conductor on a layer different from that of the memory card connector 3 through the via hole 2*b*.

Because this configuration make it possible to shorten the distance between the electrode 6 and the ground layer (or the ground strip conductor) provided on the printed wire board 2, the impedance against static electricity can be reduced and static electricity can be led to the position just in the vicinity of the opening portion 5; thus, the withstanding amount against static electricity is raised. Moreover, this configuration can be realized even when the mounting density of components on a printed wire board is high and hence no electrode can be provided on the printed wire board.

In the electronic device 100 according to Embodiment 3, for the purpose of making it possible that the memory card 4 is inserted or extracted more easily, the lower section of the opening portion 5 of the resin case 1 is recessed toward the printed wire board 2. When the recess is formed, the distance between a human body or the discharging unit 9 and the electrode is shortened; therefore, static electricity from the human body or static electricity generated by the discharging unit 9 can further readily be led to the electrode 6 and hence the withstanding amount against static electricity can further be raised.

Embodiment 4

Figure 7:
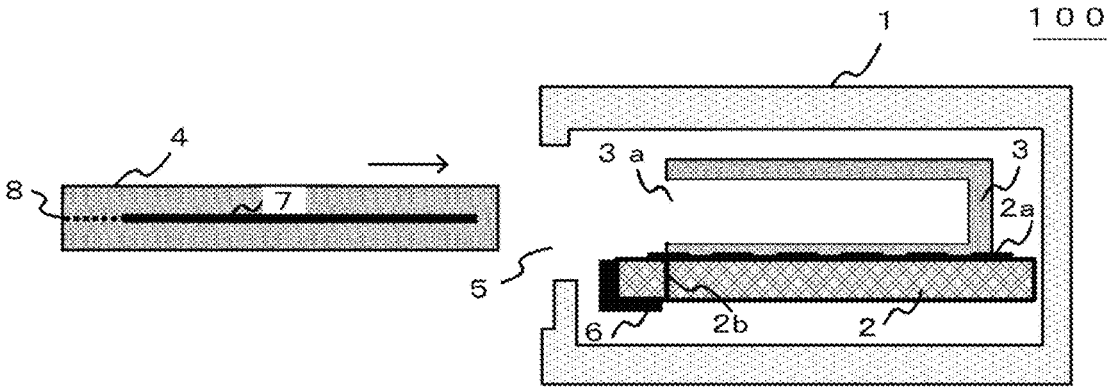
FIG. 7 is a side cross-sectional view illustrating an electronic device according to Embodiment 4 of the present invention.

As illustrated in FIG. 7, an electrode 6 (or an electrostatic induction plate 6) to be provided on the printed wire board 2 may be disposed in such a way as to expand across the side face of the printed wire board 2 and a portion of the side, of the printed wire board 2, that is opposed to the side thereof on which the memory card connector 3 is mounted. The electrode 6 is connected with the ground strip conductor on a layer the same as that of the memory card connector 3 or connected with the ground strip conductor on a layer different from that of the memory card connector 3 through the via hole 2*b*.

This configuration make it possible to shorten the distance between the electrode 6 and the ground layer (or the ground strip conductor) provided on the printed wire board 2. The impedance against static electricity can be reduced and static electricity can be led to the position just in the vicinity of the opening portion 5; thus, the withstanding amount against static electricity is raised. In comparison with the case where the electrode 6 is provided only on the side face of the printed wire board 2, it is made possible to further strongly connect the electrode 6 with the printed wire board 2.

In the electronic device 100 according to Embodiment 4, for the purpose of making it possible that the memory card 4 is inserted or extracted more easily, the lower section of the opening portion 5 of the resin case 1 is recessed toward the printed wire board 2. When the recess is formed, the distance between a human body or the discharging unit 9 and the electrode is shortened; therefore, static electricity from the human body or static electricity generated by the discharging unit 9 can further readily be led to the electrode 6 and hence the withstanding amount against static electricity can further be raised.

Embodiment 5

Figure 8:
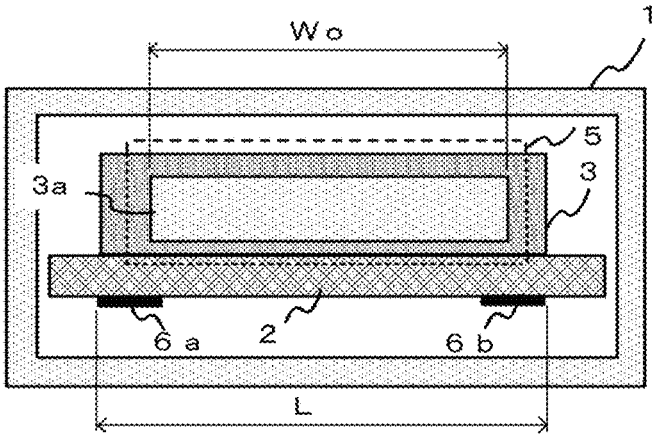
FIG. 8 is a front cross-sectional view illustrating an electronic device according to Embodiment 5 of the present invention.

As illustrated in FIG. 8, as the electrode 6 (or the electrostatic induction plate 6), small-strip electrodes 6*a* and 6*b* may be provided in such a way as to be mounted on the rear side of the printed wire board 2 and to cover only the both ends of the loaded memory card 4. The electrode 6 is connected with the ground strip conductor on a layer the same as that of the memory card connector 3 or connected with the ground strip conductor on a layer different from that of the memory card connector 3 through a via hole. The distance (L) between the respective outer edges of the electrodes 6*a* and 6*b* is larger than the transverse width (Wo) of the loading opening 3*a* provided in the memory card connector 3.

In the case where at the both ends of the memory card 4, the gap 8 of the division plane between the upper and lower portions is large and at the portion other than the both ends of the memory card 4, the gap 8 of the division plane between the upper and lower portions is small, this configuration makes it possible to form the electrode 6 so as to have as small a size as critical mass; therefore, the space and the cost can be reduced.

In the electronic device 100 according to Embodiment 5, for the purpose of making it possible that the memory card 4 is inserted or extracted more easily, the lower section of the opening portion 5 of the resin case 1 is recessed toward the printed wire board 2. When the recess is formed, the distance between a human body or the discharging unit 9 and the electrode is shortened; therefore, static electricity from the human body or static electricity generated by the discharging unit can further readily be led to the electrode 6 and hence the withstanding amount against static electricity can further be raised.

Embodiment 6

Figure 9:
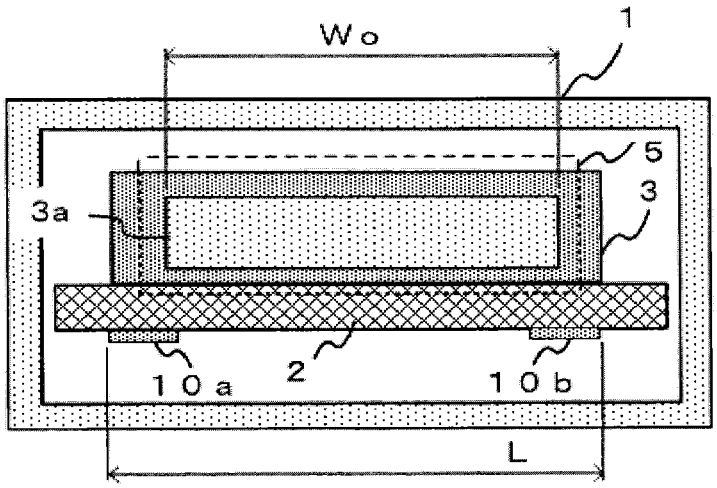
FIG. 9 is a front cross-sectional view illustrating an electronic device according to Embodiment 6 of the present invention.

As illustrated in FIG. 9, the electrode may be replaced by board-mounting capacitors 10*a* and 10*b* provided in such a way as to be mounted on the rear side of the printed wire board 2 and cover only the both ends of the loaded memory card 4. The board-mounting capacitor 10 is connected with the ground strip conductor on a layer the same as that of the memory card connector 3 or connected with the ground strip conductor on a layer different from that of the memory card connector 3 through a via hole. The distance (L) between the respective outer edges of the board-mounting capacitors 10*a* and 10*b* is larger than the transverse width (Wo) of the loading opening 3*a* provided in the memory card connector 3.

In this configuration, the electrostatic protection structure becomes three-dimensional; thus, static electricity can more readily be discharged. Moreover, the distance between the board-mounting capacitor 10 and the ground layer or the ground strip conductor provided on the printed wire board 2 can be shortened; therefore, the impedance against static electricity can be reduced.

In the electronic device 100 according to Embodiment 6, for the purpose of making it possible that the memory card 4 is inserted or extracted more easily, the lower section of the opening portion 5 of the resin case 1 is recessed toward the printed wire board 2. When the recess is formed, the distance between a human body or the discharging unit 9 and the board-mounting capacitor 10 is shortened; therefore, static electricity from the human body or static electricity generated by the discharging unit 9 can further readily be led to the board-mounting capacitor 10 and hence the withstanding amount against static electricity can further be raised.

Embodiment 7

Figure 10:
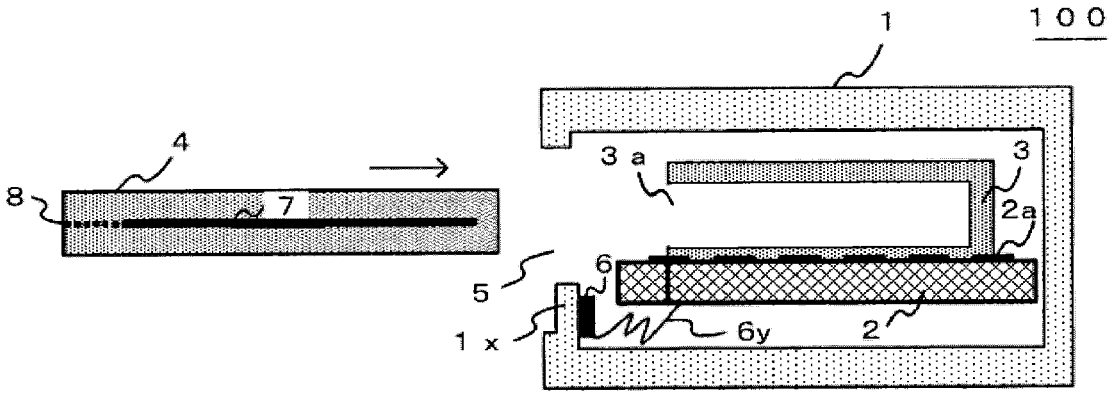
FIG. 10 is a side cross-sectional view illustrating an electronic device according to Embodiment 7 of the present invention.
Figure 11:
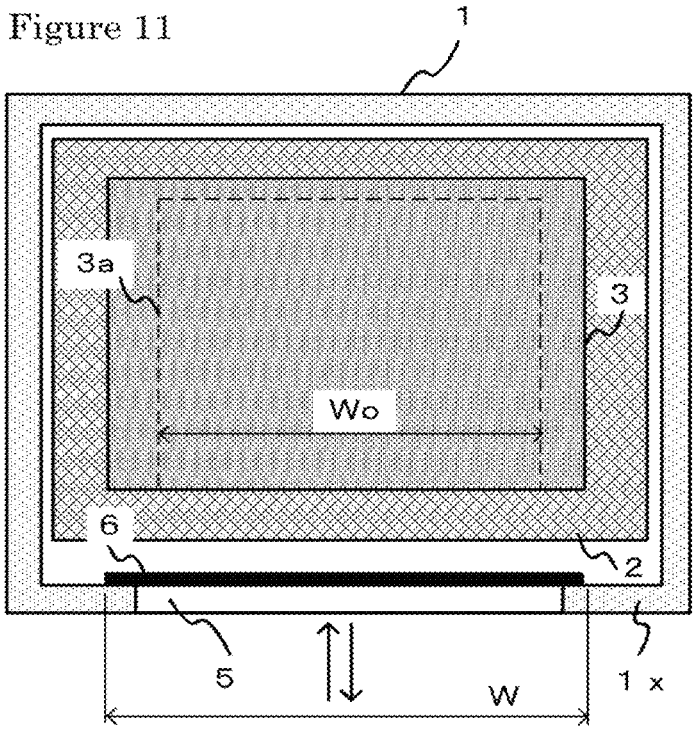
FIG. 11 is a top cross-sectional view illustrating the electronic device according to Embodiment 7 of the present invention.

The electrode 6 (or the electrostatic induction plate 6) may be disposed on the inner surface of the resin case 1, as illustrated in FIGS. 10 and 11. In this case, it is desirable that the electrode 6 is formed of a conductive tape. The electrode 6 is electrically connected with a layer the same as or different from the layer of the memory card connector 3 through a wiring lead 6*y*. It is desirable that in preparation for detaching the printed wire board 2 from the resin case 1, the wiring lead 6*y* is attachable and detachable. The electrode 6 is led to the printed wire board 2 by way of such a wiring lead and then is connected with the ground strip conductor on a layer the same as that of the memory card connector 3 or connected with the ground strip conductor on a layer different from that of the memory card connector 3 through the via hole 2*b*.

The electrode 6 is formed on the side wall 1*x*, of the resin case 1, that is in the vicinity of the loading opening. The transverse width (W) of the electrode 6 is larger than the transverse width of the loading opening 3*a* of the memory card connector 3 or the transverse width of the memory card 4. Because this configuration makes it possible to lead static electricity at a position just in the vicinity of the opening portion 5, the withstanding amount against static electricity is raised. Moreover, this configuration can be realized even when the mounting density of components on a printed wire board is high and hence no electrode can be provided on the printed wire board.

In the electronic device 100 according to Embodiment 7, for the purpose of making it possible that the memory card 4 is inserted or extracted more easily, the lower section of the opening portion 5 of the resin case 1 is recessed toward the printed wire board 2. When the recess is formed, the distance between a human body or the discharging unit 9 and the electrode is shortened; therefore, static electricity from the human body or static electricity generated by the discharging unit can further readily be led to the electrode 6 and hence the withstanding amount against static electricity can further be raised.

Embodiment 8

Figure 12:
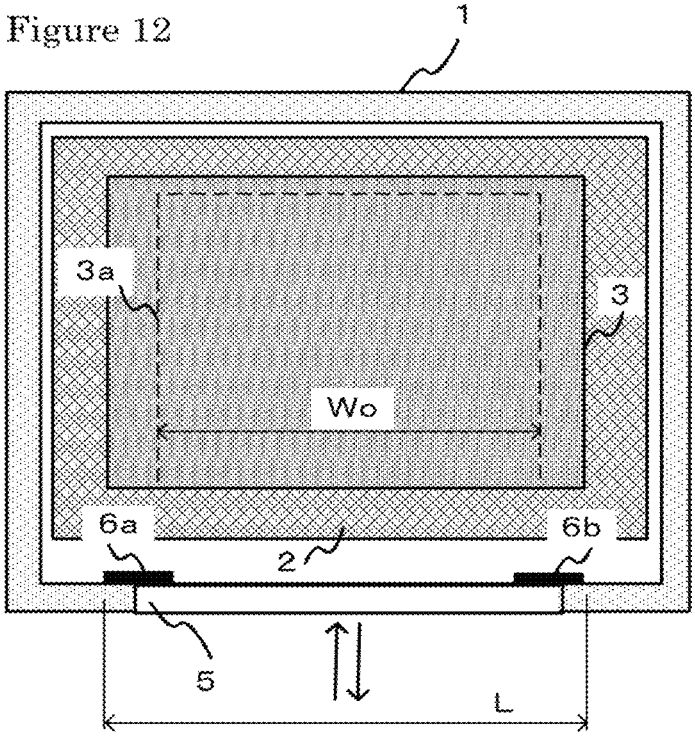
FIG. 12 is a top cross-sectional view illustrating an electronic device according to Embodiment 8 of the present invention.

As illustrated in FIG. 12, the electrodes 6*a* and 6*b* (or the electrostatic induction plates 6*a* and 6*b*) are provided in such a way as to be mounted on the resin case 1 and to cover only the both ends of the loaded memory card 4. In this case, it is desirable that the electrode 6 is formed of a conductive tape. The electrode 6 is electrically connected with a layer the same as or different from the layer of the memory card connector 3 through a wiring lead. It is desirable that in preparation for detaching the printed wire board 2 from the resin case 1, the wiring lead is attachable and detachable. The distance (L) between the respective outer edges of the electrodes 6*a* and 6*b* is larger than the transverse width (Wo) of the loading opening 3*a* provided in the memory card connector 3.

The electrode 6 is led to the printed wire board 2 by way of such a wiring lead and then is connected with the ground strip conductor on a layer the same as that of the memory card connector 3 or connected with the ground strip conductor on a layer different from that of the memory card connector 3 through the via hole 2*b*. In the case where at the both ends of the memory card 4, the gap 8 of the division plane between the upper and lower portions is large and at the portion other than the both ends of the memory card 4, the gap 8 of the division plane between the upper and lower portions is small, this configuration makes it possible to form the electrode 6 so as to have as small a size as critical mass; therefore, the cost can be reduced.

In the electronic device 100 according to Embodiment 8, for the purpose of making it possible that the memory card 4 is inserted or extracted more easily, the lower section of the opening portion 5 of the resin case 1 is recessed toward the printed wire board 2. When the recess is formed, the distance between a human body or the discharging unit 9 and the electrode is shortened; therefore, static electricity from the human body or static electricity generated by the discharging unit 9 can further readily be led to the electrode 6 and hence the withstanding amount against static electricity can further be raised.

Embodiment 9

Figure 13:
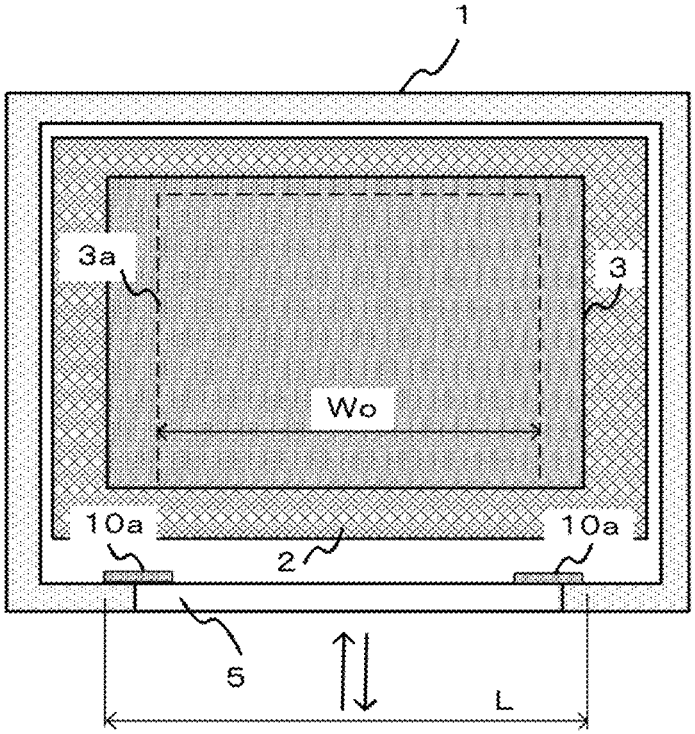
FIG. 13 is a top cross-sectional view illustrating an electronic device according to Embodiment 9 of the present invention.

As illustrated in FIG. 13, the board-mounting capacitors 10*a* and 10*b* are provided in such a way as to be mounted on the resin case 1 and to cover only the both ends of the loaded memory card 4. In this case, the board-mounting capacitor 10 is electrically connected with a layer the same as or different from the layer of the memory card connector 3 through a wiring lead. It is desirable that in preparation for detaching the printed wire board 2 from the resin case 1, the wiring lead is attachable and detachable. The board-mounting capacitor 10 is led to the printed wire board 2 by way of such a wiring lead and then is connected with the ground strip conductor on a layer the same as that of the memory card connector 3 or connected with the ground strip conductor on a layer different from that of the memory card connector 3 through the via hole 2*b*.

The distance (L) between the respective outer edges of the board-mounting capacitors 10*a* and 10*b* is larger than the transverse width (Wo) of the loading opening 3*a* provided in the memory card connector 3. In this configuration, the electrostatic protection structure becomes three-dimensional; thus, static electricity can more readily be discharged. Moreover, because this configuration makes it possible to lead static electricity at a position just in the vicinity of the opening portion 5, the withstanding amount against static electricity is raised. Furthermore, this configuration can be realized even when the mounting density of components on a printed wire board is high and hence no electrode can be provided on the printed wire board.

In the electronic device 100 according to Embodiment 9, for the purpose of making it possible that the memory card 4 is inserted or extracted more easily, the lower section of the opening portion 5 of the resin case 1 is recessed toward the printed wire board 2. When the recess is formed, the distance between a human body or the discharging unit 9 and the board-mounting capacitor 10 is shortened; therefore, static electricity from the human body or static electricity generated by the discharging unit 9 can further readily be led to the board-mounting capacitor 10 and hence the withstanding amount against static electricity can further be raised.

Embodiment 10

Figure 14:
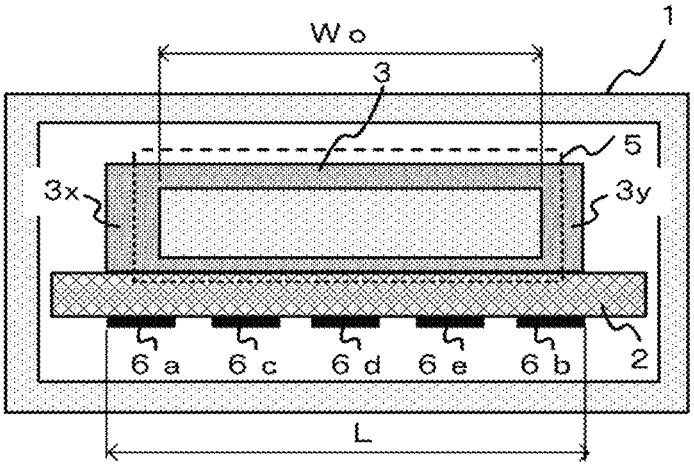
FIG. 14 is a front cross-sectional view illustrating an electronic device according to Embodiment 10 of the present invention.

FIG. 14 is a front cross-sectional view illustrating an electronic device 100 according to Embodiment 10 of the present invention. The memory card connector 3 has sidewalls 3*x* and 3*y* that face each other. Small-strip electrostatic induction plates 6*a* through 6*e* (or electrodes 6*a* through 6*e*), aligned in one row, are formed on the rear side of the printed wire board 2. The electrostatic induction plate 6*a* is disposed below (or immediately beneath) the sidewall 3*x* of the memory card connector 3 when viewed from the front side. The electrostatic induction plate 6*b* is disposed below (or immediately beneath) the sidewall 3*y* of the memory card connector 3 when viewed from the front side. The small-strip electrostatic induction plates 6*c* through 6*e*, connected with the ground, are formed between the electrostatic induction plate 6*a* and the electrostatic induction plate 6*b*. The electrostatic induction plate 6 is connected with the ground strip conductor on a layer the same as that of the memory card connector 3 or connected with the ground strip conductor on a layer different from that of the memory card connector 3 through a via hole.

When the metal electrostatic induction plate formed on the rear side of the printed wire board 2 is configured with three or more small strips, it is made possible to more locally create the place where the intensity of an electromagnetic field generated by a current produced when static electricity is led to the electrostatic induction plate is weak. It is preferable that electronic components susceptible to static electricity are mounted in the place having a weak field intensity. It is desirable that the distance (L) between the respective outer edges of the electrostatic induction plates 6*a* and 6*b*, arranged at the outmost positions, is larger than the transverse width (Wo) of the loading opening 3*a* of the memory card connector 3 or the transverse width (Wm) of the memory card 4. Hereinafter, there will be described the behavior of static electricity from a human body or static electricity generated by the discharging unit 9, which are applied to the opening portion 5.

When static electricity is applied from the upper portion of the memory card 4 to the printed wire board 2, the static electricity is led to the memory card connector 3. The memory card connector 3 prevents the static electricity from being applied to IC 7 by way of the gap 8 of the memory card 4. Because the memory card connector 3 is disposed in the electronic device 100, static electricity is hardly led from the upper portion of the memory card 4 to IC 7. As a result, the malfunction, caused by static electricity, in the circuit electrically connected with IC 7 can be suppressed.

When static electricity is applied from the lower portion of the memory card 4 to the printed wire board 2, the static electricity is hardly led to the memory card connector 3 because there exists almost no gap between the memory card 4 and the memory card connector 3. However, in the case where only a single electrostatic induction plate is provided, an electromagnetic field generated by a current produced when static electricity is led to the electrostatic induction plate may cause an abnormality in communication between the memory card 4 and the electronic device 100. Because in Embodiment 10, the electrostatic induction plates 6*c* through 6*e* are provided, static electricity from a human body or static electricity generated by the discharging unit 9 can be led to the electrostatic induction plate 6. In other words, in comparison with the case where the electrostatic induction plates 6*c* through 6*e* are not provided, the withstanding amount against static electricity is raised.

Figure 15:
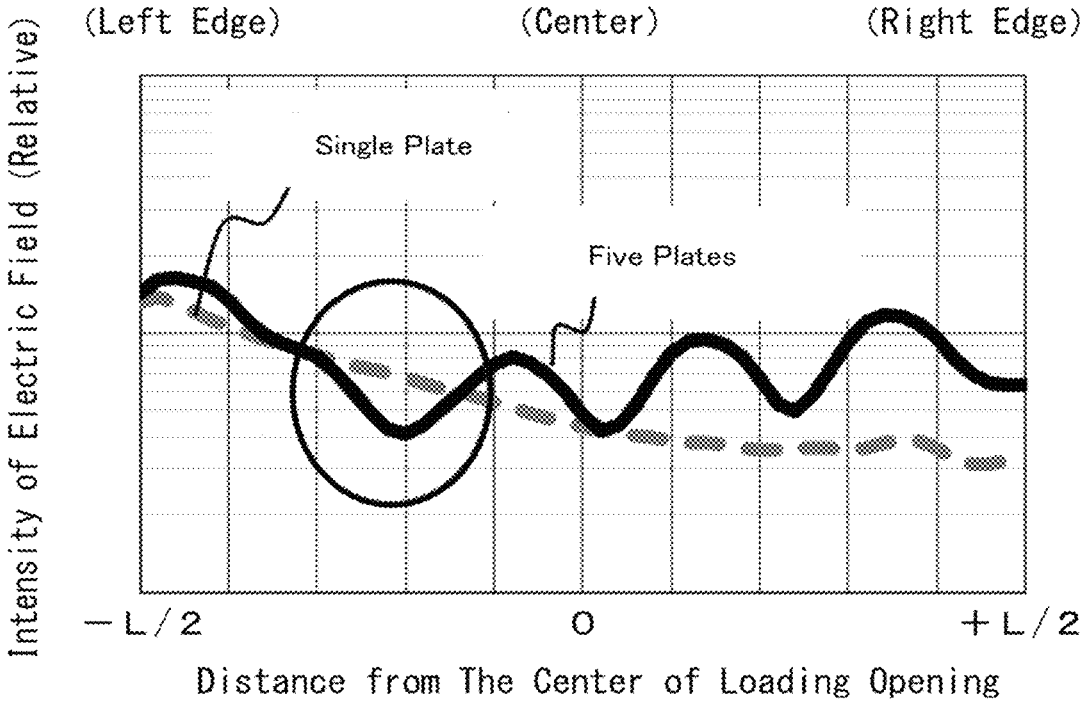
FIG. 15 is the result of electric-field-strength analysis for explaining the effect of an electrostatic induction plate.

FIG. 15 represents the result of analyzing the intensity of an electric field produced on the electrostatic induction plate with regard to the case where only a single electrostatic induction plate is provided (refer to FIG. 3) and the case where five electrostatic induction plates are provided (refer to FIG. 14). An electromagnetic wave emitter is disposed at the left side of the drawing. As can be seen from the graph in FIG. 15, represented in such a way that the foregoing cases are compared with each other, the electric-field intensity at the time when five electrostatic induction plates are provided can be weakened in the circled part of the graph, in comparison with the case where only a single electrostatic induction plate is provided. In other words, when the electrostatic induction plate consisting of a plurality of small strips is disposed, it is made possible to locally create the place where the intensity of an electromagnetic field generated by a current produced when static electricity is led to the electrostatic induction plate is weak. When components susceptible to static electricity are arranged at the position where the electric-field intensity is weak, it is made possible to suppress an electromagnetic field, generated by a current produced when static electricity is led to the electrostatic induction plate, from causing an abnormality in communication between the memory card and the electronic device. Even when only a single small-strip electrostatic induction plate is provided between the electrostatic induction plate 6*a* and the electrostatic induction plate 6*b*, the same effect can be demonstrated.

The plurality of electrostatic induction plates 6 are provided at positions on the side, of the printed wire board 2, that is opposite to the memory card connector 3 side; the positions are closer to the opening portion 5 than the memory card connector 3. The distance between the respective outmost edges of the plurality of electrostatic induction plates 6 is larger than the transverse width of the memory card 4. Accordingly, not only when static electricity is applied from the opening portion above the memory card 4 but also when static electricity is applied from the lower portion of the memory card, the static electricity can be led to the plurality of electrostatic induction plates 6. Moreover, the static electricity can be suppressed from reaching IC 7 of the memory card 4, and it is made possible to locally create the place where the intensity of an electromagnetic field generated by a current produced when static electricity is led to the electrostatic induction plate is weak. When IC 7 of the memory card 4, which is susceptible to electromagnetic noise, is disposed at this position where the electric-field intensity is locally weak, the withstanding amount against static electricity can be raised at low cost.

Embodiment 11

Figure 16:
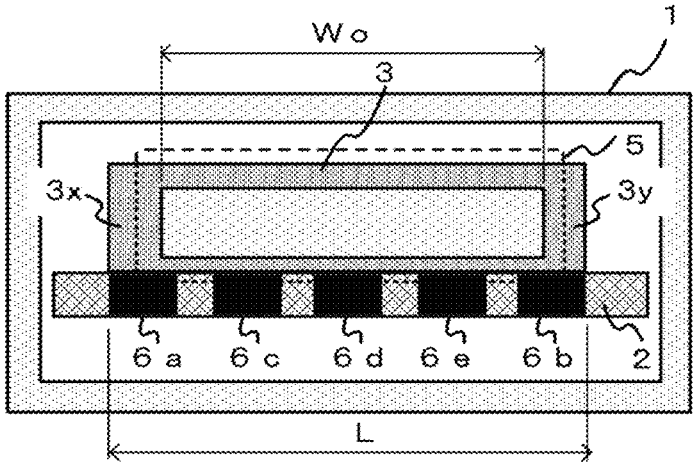
FIG. 16 is a front cross-sectional view illustrating an electronic device according to Embodiment 11 of the present invention.

FIG. 16 is a front cross-sectional view illustrating an electronic device according to Embodiment 11 of the present invention. Small-strip electrostatic induction plates 6*a* through 6*e* (or electrodes 6*a* through 6*e*), aligned in one row, are formed on the side face, of the printed wire board 2, that is in the vicinity of the loading opening. The electrostatic induction plate 6*a* is disposed below (or immediately beneath) the sidewall 3*x* of the memory card connector 3 when viewed from the front side. The electrostatic induction plate 6*b* is disposed below (or immediately beneath) the sidewall 3*y* of the memory card connector 3 when viewed from the front side. The electrostatic induction plates 6*c* through 6*e*, connected with the ground, are formed between the electrostatic induction plate 6*a* and the electrostatic induction plate 6*b*. The electrostatic induction plate 6 is connected with the ground strip conductor on a layer the same as that of the memory card connector 3 or connected with the ground strip conductor on a layer different from that of the memory card connector 3 through a via hole.

In Embodiment 11, the electrostatic induction plate formed on the side face, of the printed wire board 2, that is in the vicinity of the loading opening is configured with three or more small strips. As a result, it is made possible to more locally create the place where the intensity of an electromagnetic field generated by a current produced when static electricity is led to the electrostatic induction plate is weak; therefore, components susceptible to static electricity can be mounted. It is desirable that the distance (L) between the respective outer edges of the electrostatic induction plates 6*a* and 6*b*, arranged at the outmost positions, is larger than the transverse width (Wo) of the loading opening 3*a* of the memory card connector 3 or the transverse width (Wm) of the memory card 4.

Embodiment 12

Figure 17:
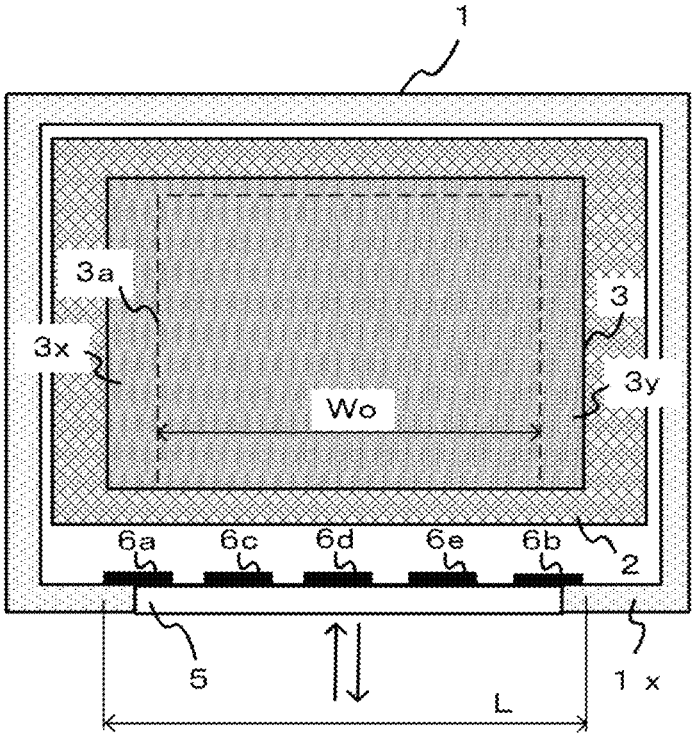
FIG. 17 is a top cross-sectional view illustrating an electronic device according to Embodiment 12 of the present invention.

FIG. 17 is a top cross-sectional view illustrating an electronic device according to Embodiment 12 of the present invention. Small-strip electrostatic induction plates 6*a* through 6*e* are formed on the side wall 1*x*, of the resin case 1, that is in the vicinity of the loading opening. The electrostatic induction plates 6*c* through 6*e* are arranged between the electrostatic induction plate 6*a* and the electrostatic induction plate 6. The electrostatic induction plate 6*a* and the sidewall 3*x* are disposed on the same straight line when viewed from the top side. The electrostatic induction plate 6*b* and the sidewall 3*y* are disposed on the same straight line when viewed from the top side. The distance (L) between the respective outer edges of the electrostatic induction plate 6*a* and the electrostatic induction plate 6*b* is larger than the transverse width of the loading opening 3*a* of the memory card connector 3 or the transverse width of the memory card 4.

Because this configuration makes it possible to lead static electricity at a position just in the vicinity of the opening portion 5, the withstanding amount against static electricity is raised. Moreover, this configuration can be realized even when the mounting density of components on a printed wire board is high and hence no electrostatic induction plate can be provided on the printed wire board. Furthermore, in the case where at the both ends of the memory card 4, the gap 8 of the division plane between the upper and lower portions is large and at the portion other than the both ends of the memory card 4, the gap 8 of the division plane between the upper and lower portions is small, this configuration makes it possible to form the electrostatic induction plate 6 so as to have as small a size as critical mass; therefore, the cost can be reduced. When the electrostatic induction plate is configured with three or more small strips, it is made possible to more locally create the place where the intensity of an electromagnetic field generated by a current produced when static electricity is led to the electrostatic induction plate is weak; therefore, components susceptible to static electricity can be mounted.

Embodiment 13

Figure 18:
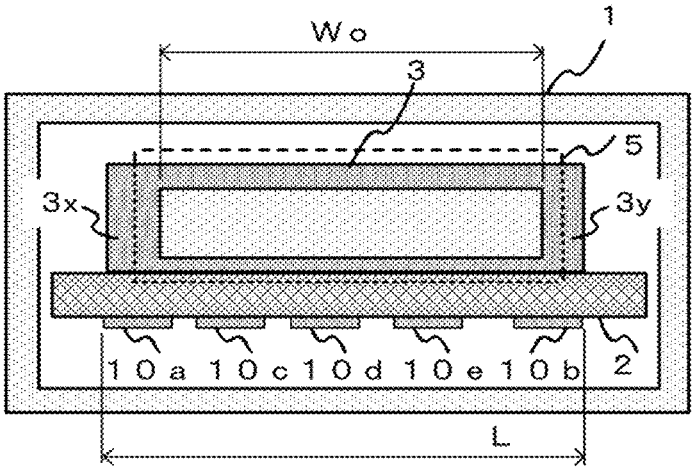
FIG. 18 is a front cross-sectional view illustrating an electronic device according to Embodiment 13 of the present invention.

FIG. 18 is a front cross-sectional view illustrating an electronic device according to Embodiment 13 of the present invention. The memory card connector 3 has sidewalls 3*x* and 3*y* that face each other. Small-strip board-mounting capacitors 10*a* through 10*e*, aligned in one row, are formed on the rear side of the printed wire board 2. The board-mounting capacitor 10*a* is disposed below (or immediately beneath) the sidewall 3*x* of the memory card connector 3 when viewed from the front side. The board-mounting capacitor 10*b* is disposed below (or immediately beneath) the sidewall 3*y* of the memory card connector 3 when viewed from the front side. The board-mounting capacitors 10*c* through 10*e*, connected with the ground, are formed between the board-mounting capacitor 10*a* and the board-mounting capacitor 10*b*. The board-mounting capacitor 10 is connected with the ground strip conductor on a layer the same as that of the memory card connector 3 or connected with the ground strip conductor on a layer different from that of the memory card connector 3 through a via hole.

When the board-mounting capacitor formed on the rear side of the printed wire board 2 is configured with three or more small strips, it is made possible to more locally create the place where the intensity of an electromagnetic field generated by a current produced when static electricity is led to the board-mounting capacitor is weak. It is preferable that components susceptible to static electricity are mounted in the place having a weak field intensity. It is desirable that the distance (L) between the respective outer edges of the board-mounting capacitors 10*a* and 10*b*, arranged at the outmost positions, is larger than the transverse width (Wo) of the loading opening 3*a* of the memory card connector 3 or the transverse width (Wm) of the memory card 4. When the board-mounting capacitor is configured with three or more small strips, it is made possible to more locally create the place where the intensity of an electromagnetic field generated by a current produced when static electricity is led to the board-mounting capacitor is weak; therefore, components susceptible to static electricity can be mounted.

Embodiment 14

Figure 19:
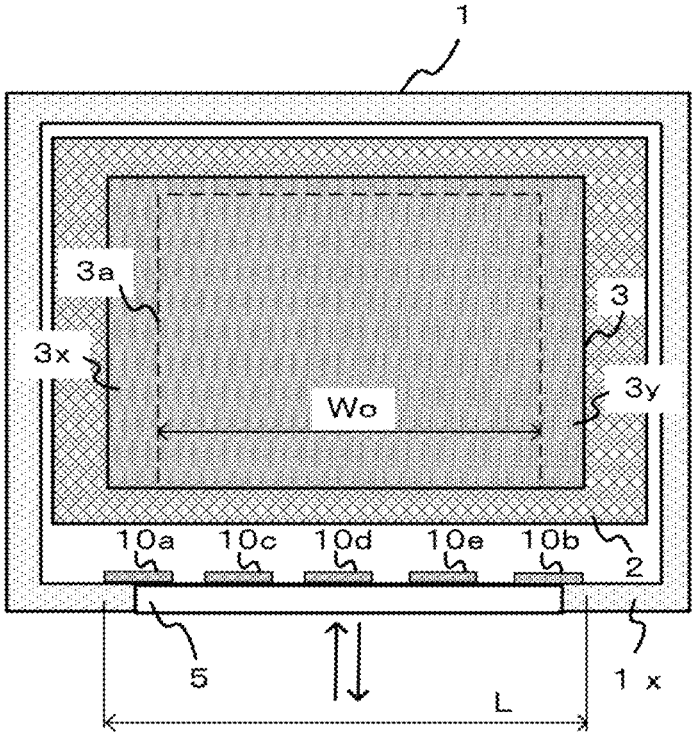
FIG. 19 is a top cross-sectional view illustrating an electronic device according to Embodiment 14 of the present invention.

FIG. 19 is a top cross-sectional view illustrating an electronic device according to Embodiment 14 of the present invention. Small-strip board-mounting capacitors 10*a* through 10*e* are formed on the side wall 1*x*, of the resin case 1, that is in the vicinity of the loading opening. The board-mounting capacitors 10*c* through 10*e* are arranged between the board-mounting capacitor 10*a* and the board-mounting capacitor 10*b*. The board-mounting capacitor 10*a* and the side wall 3*x* are disposed on the same straight line when viewed from the top side. The board-mounting capacitor 10*b* and the side wall 3*y* are disposed on the same straight line when viewed from the top side. The distance (L) between the respective outer edges of the board-mounting capacitor 10*a* and the board-mounting capacitor 10*b* is larger than the transverse width of the loading opening 3*a* of the memory card connector 3 or the transverse width of the memory card 4.

Because this configuration makes it possible to lead static electricity at a position just in the vicinity of the opening portion 5, the withstanding amount against static electricity is raised. Moreover, this configuration can be realized even when the mounting density of components on a printed wire board is high and hence no electrostatic induction plate can be provided on the printed wire board. Furthermore, in the case where at the both ends of the memory card 4, the gap 8 of the division plane between the upper and lower portions is large and at the portion other than the both ends of the memory card 4, the gap 8 of the division plane between the upper and lower portions is small, this configuration makes it possible to form the board-mounting capacitor 10 so as to have as small a size as critical mass; therefore, the cost can be reduced. When the board-mounting capacitor is configured with three or more small strips, it is made possible to more locally create the place where the intensity of an electromagnetic field generated by a current produced when static electricity is led to the board-mounting capacitor is weak; therefore, components susceptible to static electricity can be mounted.

In the scope of the present invention, the embodiments thereof can freely be combined with one another and can appropriately be modified or omitted.

DESCRIPTION OF REFERENCE NUMERALS

1: resin case, 1*x*: sidewall, 1*y*: sidewall, 1*z*: bottom side
2: printed wire board, 2*a*: ground layer, 2*b*: via hole, 2*x*: margin
3: memory card connector, 3*a*: loading opening, 3*x*: sidewall, 3*y*: sidewall
4: memory card
5: opening portion
6: electrode (electrostatic induction plate), 6*a*: electrode (electrostatic induction plate), 6*b*: electrode (electrostatic induction plate), 6*y*: wiring lead
7: IC
8: gap
9: discharging electric machine (discharging unit)
10: board-mounting capacitor, 10*a*: board-mounting capacitor, 10*b*: board-mounting capacitor, 11: recess
100: electronic device, X: loading opening side, Y: rear side

The invention claimed is:

1. An electronic device comprising:

a memory card connector that is provided with a loading opening for a memory card in the side face thereof and has a first sidewall and a second sidewall facing each other;

a printed circuit board that has a first main face and a second main face facing each other, on which a ground is formed, and on the first main face of which the memory card connector is placed leaving a margin at the loading opening side; and a resin case that contains the printed circuit board and the memory card connector and in the sidewall of which at the loading opening side, an opening portion through which the memory card is inserted is formed, wherein on the second main face of the printed circuit board, there are formed a first electrode, a second electrode, and a third electrode that are each connected with the ground, and that are independent from each other, and wherein the first electrode is disposed below the first sidewall of the memory card connector and the second electrode is disposed below the second sidewall of the memory card connector, the third electrode is disposed between the first electrode and the second electrode, and the first electrode, the third electrode and the second electrode are arranged in a line.

2. An electronic device comprising:

a memory card connector that is provided with a loading opening for a memory card in the side face thereof and has a first sidewall and a second sidewall facing each other;

a printed circuit board that has a first main face and a second main face facing each other, on which a ground is formed, and on the first main face of which the memory card connector is placed leaving a margin at the loading opening side; and a resin case that contains the printed circuit board and the memory card connector and in the sidewall of which at the loading opening side, an opening portion through which the memory card is inserted is formed, wherein on the side face of the printed circuit board at the loading opening side, there are formed a first electrode, a second electrode, and a third electrode that are each connected with the ground and are independent from each other, and wherein the first electrode is disposed below the first sidewall of the memory card connector, the second electrode is disposed below the second sidewall of the memory card connector, the third electrode is disposed between the first electrode and the second electrode and the first electrode, the third electrode and the second electrode are arranged in a line.

3. An electronic device comprising:

a memory card connector provided with a loading opening for a memory card in the side face thereof;

a printed circuit board that has a first main face and a second main face facing each other, on which a ground is formed, and on the first main face of which the memory card connector is placed leaving a margin at the loading opening side; and a resin case that contains the printed circuit board and the memory card connector and in the sidewall of which at the loading opening side, an opening portion through which the memory card is inserted is formed, wherein on the sidewall of the resin case at the loading opening side, there are formed a first electrode, a second electrode, and a third electrode that are each connected with the ground and are independent from each other, and wherein the first electrode, the second electrode, and the third electrode are disposed on the inner side of the side wall at the loading opening side, the distance between the respective outer edges of the first electrode and the second electrode is larger than the transverse width of the memory card, the third electrode is disposed between the first electrode and the second electrode, and the first electrode, the third electrode and the second electrode are arranged in a line.

4. The electronic device according to claim 1, wherein the third electrode includes small plates of electrodes that are connected with the ground.

5. The electronic device according to claim 1, wherein the ground is formed on a layer different from a layer on which the first electrode and the second electrode are formed, and the first electrode, the second electrode and the third electrode are electrically connected with the ground through respective via holes.

6. The electronic device according to claim 2, wherein the ground is formed on a layer different from a layer on which the first electrode, the second electrode and the third electrode are formed, and the first electrode and the second electrode are electrically connected with the ground through respective via holes.

7. The electronic device according to claim 3, wherein the ground is formed on a layer different from a layer on which the first and the second electrodes are formed, and the first electrode, the second electrodes and the third electrode are electrically connected with the ground through respective via holes.

8. The electronic device according to claim 1, wherein the respective longitudinal widths of the first and the second electrodes are larger than the depth of the margin.

9. The electronic device according to claim 1, wherein the distance between the respective outer edges of the first electrode and the second electrode is larger than the transverse width of the loading opening for the memory card.

10. The electronic device according to claim 2, wherein the distance between the respective outer edges of the first electrode and the second electrode is larger than the transverse width of the loading opening for the memory card.

11. The electronic device according to claim 3, wherein the distance between the respective outer edges of the first electrode and the second electrode is larger than the transverse width of the loading opening for the memory card.

12. The electronic device according to claim 4, wherein the third electrode includes three small plates of electrodes.

* * * * *